US010857686B2

(12) United States Patent
Wu

(10) Patent No.: US 10,857,686 B2
(45) Date of Patent: Dec. 8, 2020

(54) RECIPROCATING ELECTRIC RAZOR HEAD

(71) Applicant: Little Stone Ceramic Blade (Zhongshan) Company Ltd., Guangdong (CN)

(72) Inventor: Rangpan Wu, Guangdong (CN)

(73) Assignee: Little Stone Ceramic Blade (Zhongshan) Company Ltd., Zhongshan (CN)

( * ) Notice: Subject to any disclaimer, the term of this patent is extended or adjusted under 35 U.S.C. 154(b) by 54 days.

(21) Appl. No.: 15/978,195

(22) Filed: May 14, 2018

(65) Prior Publication Data

US 2018/0257248 A1 Sep. 13, 2018

Related U.S. Application Data

(63) Continuation-in-part of application No. PCT/CN2016/105186, filed on Nov. 9, 2016.

(30) Foreign Application Priority Data

Oct. 12, 2016 (CN) ..... 2016 1 0889953

(51) Int. Cl.
*B26B 19/04* (2006.01)
*B26B 19/06* (2006.01)
(Continued)

(52) U.S. Cl.
CPC ..... *B26B 19/063* (2013.01); *B26B 19/042* (2013.01); *B26B 19/046* (2013.01);
(Continued)

(58) Field of Classification Search
CPC ..... B26B 19/042; B26B 19/046; B26B 19/06; B26B 19/063; B26B 19/08; B26B 19/3846; B26B 19/384
(Continued)

(56) References Cited

U.S. PATENT DOCUMENTS 2,151,965 A * 3/1939 Hanley ..... B26B 19/042 30/43.92
2,231,466 A * 2/1941 Hanley ..... B26B 19/28 310/47
(Continued)

FOREIGN PATENT DOCUMENTS

CN 104999484 A 10/2015
CN 204954880 U 1/2016
(Continued)

OTHER PUBLICATIONS

International Search Report of PCT Patent Application No. PCT/CN2016/105186 dated Jul. 3, 2017.

*Primary Examiner* — Clark F Dexter

(57) ABSTRACT

A reciprocating electric razor head includes a fixed blade and a fixed blade support for supporting and fixing the fixed blade. The fixed blade is provided with hair entrance holes for body hair to enter, and an inner side of the fixed blade is provided with a movable blade capable of moving backward and forward in a reciprocating manner relative to the fixed blade to cut off the body hair inside the hair entrance holes, such that the fixed blade obtains a very flat cutting working face contacting the movable blade without the need for additional precision machining.

8 Claims, 8 Drawing Sheets

(51) Int. Cl.
*B26B 19/08* (2006.01)
*B26B 19/38* (2006.01)

(52) U.S. Cl.
CPC ..... *B26B 19/06* (2013.01); *B26B 19/08* (2013.01); *B26B 19/384* (2013.01); *B26B 19/3846* (2013.01)

(58) Field of Classification Search
USPC ..... 30/43.92, 346.51
See application file for complete search history.

(56) References Cited

U.S. PATENT DOCUMENTS 2,289,518 A * 7/1942 Raia ..... B26B 19/04 30/43.2
2,406,035 A * 8/1946 Pinkas ..... B26B 19/042 30/43.92
3,068,568 A * 12/1962 Schnapp ..... B26B 19/04 30/346.51
3,098,295 A * 7/1963 Wahl ..... B26B 19/04 30/43.92
3,893,236 A * 7/1975 Nissen ..... B26B 19/384 30/43
4,174,568 A * 11/1979 Mixner ..... B26B 19/10 30/34.1
4,926,552 A * 5/1990 Otsuka et al. ..... B26B 19/04 30/346.51
5,127,163 A * 7/1992 Locke ..... B26B 19/384 30/346.51
5,390,415 A * 2/1995 Momose ..... A45D 27/46 30/41
5,901,446 A * 5/1999 Szymansky ..... B26B 19/384 30/346.51
2007/0169350 A1* 7/2007 Oh ..... B26B 19/04 30/43.92
2010/0162568 A1* 7/2010 Kawaguchi ..... B26B 19/384 30/43.92
2010/0212160 A1* 8/2010 Liu ..... B26B 19/042 30/43.92
2010/0236073 A1* 9/2010 Forsdike et al. ..... B26B 19/04 30/43.2
2010/0325893 A1* 12/2010 Komori et al. ..... B26B 19/04 30/43.92

FOREIGN PATENT DOCUMENTS

FR 2 531 365 * 2/1984 ..... B26B 19/04
FR 2 531 898 * 2/1984 ..... B26B 19/145

* cited by examiner

RECIPROCATING ELECTRIC RAZOR HEAD

CROSS REFERENCE TO RELATED APPLICATIONS

The present application is a Continuation-In-Part Application of PCT Application No. PCT/CN2016/105186 filed on Nov. 9, 2016, which claims the benefit of Chinese Patent Application No. 201610889953.7 filed on Oct. 12, 2016. All the above are hereby incorporated by reference.

TECHNICAL FIELD

The present invention relates to a reciprocating electric razor head.

BACKGROUND ART

As for commercially available reciprocating electric razor heads, long body hair typically can't be cut clean in one time. Therefore, two sets of blades are required: one set of blades cut long hair first, and then, the other set of blades cut remaining short hair; alternatively, although long body hair can be cut off by these razor heads in one time, as limited by their structures, fixed blades or shaver caps can't be made to be fairly thin. Consequently, the hair remains after shaving, thus leading to unclean shaving.

The present invention is created based on this situation.

SUMMARY OF THE INVENTION

It is an object of the present invention to overcome the deficiencies present in the prior art and provide a reciprocating electric razor head featured by low costs and a simple and reliable structure, wherein the reciprocating electric razor head is capable of cleanly removing body hair in one time.

As compared with the prior art, the present invention has the following advantages:

1, the present invention is featured by a simple structure, a small volume and a compact size.

2, in the present invention, the fixed blade is a flexible metal sheet, which is featured by suppleness and toughness, and the fixed blade support is of an arcuate structure having rigidness. Moreover, the fixed blade is tensioned and then fixed to both sides of the fixed blade support to form a structure similar to a bow-bowstring one, wherein the bowstring is stretched by means of the bow, such that the bowstring (namely the fixed blade) has a stretching force. With this bow-bowstring structure, the fixed blade can be tightened, via the stretching force, to the fixed blade support to form a stable shaving face thereon. As the shaving face is not required to be maintained through the rigidness of the material, the rigidness requirements for the fixed blade are extremely low, or the fixed blade is not required to be rigid. Consequently, the thickness of the fixed blade can be made to be ultra-thin, which can't be implemented in other process structures. As such, the influence exerted by the thickness of the fixed blade is negligible during shaving, and body hair can be removed cleanly in one time.

3, as it is a flexible metal sheet, and is propped open by the fixed blade support in an outward manner and tightened thereto, the fixed blade of the present invention can obtain a very flat cutting working face contacting the movable blade without the need for additional precision machining.

Furthermore, the processes for making and processing the fixed blade are simple, and machining is convenient. As such, costs are reduced.

4, as for the process of the present invention for fixing the fixed blade to the fixed blade support, both left and right ends of the fixed blade are supported by the edges on both left and right sides of the fixed blade support, and are bent and tensioned downwardly along an arcuate outer side of the fixed blade support to lie flat against the fixed blade support and below the cutting plane of the fixed blade, namely on the lateral face or bottom face of the fixed blade support, and the fixed blade is fixed by means of welding, riveting or gluing. This process is simple and convenient to operate, and the smoothness of the cutting working face can be prevented from being affected in the process for fixing the fixed blade to the fixed blade support. Moreover, as both left and right ends of the fixed blade are supported by the edges on both left and right sides of the fixed blade support and bent downwardly, an R angle is formed, such that the surface where the fixed blade contacts the skin is smooth, thus offering comfortable shaving experience and high safety.

5, in the present invention, the fixed blade has a thickness of h, which satisfies $0<h\leq 0.08$ mm, and with the adoption of an ultra-thin flexible metal sheet, body hair can be removed more completely and cleanly.

6, in the present invention, as a movable blade pressing member capable of pressing the movable blade on the fixed blade is provided between the movable blade and the fixed blade support, body hair can be removed more easily, which confirms the sharpness of the reciprocating electric razor head.

7, in the present invention, a through-hole is provided in the middle of the movable blade, and the movable blade is further provided with movable blade connecting portions projecting beyond the body of the movable blade. In this manner, the movable blade connecting portions may be prevented from being deformed in the process (e.g., welding or riveting) for fixedly connecting the movable blade connecting portions with the movable blade support connecting portions. Consequently, the flatness of the movable blade is improved, thus ensuring the sharpness of the overall cutting point of the reciprocating electric razor head.

DETAILED DESCRIPTION OF THE INVENTION

Figure 1:
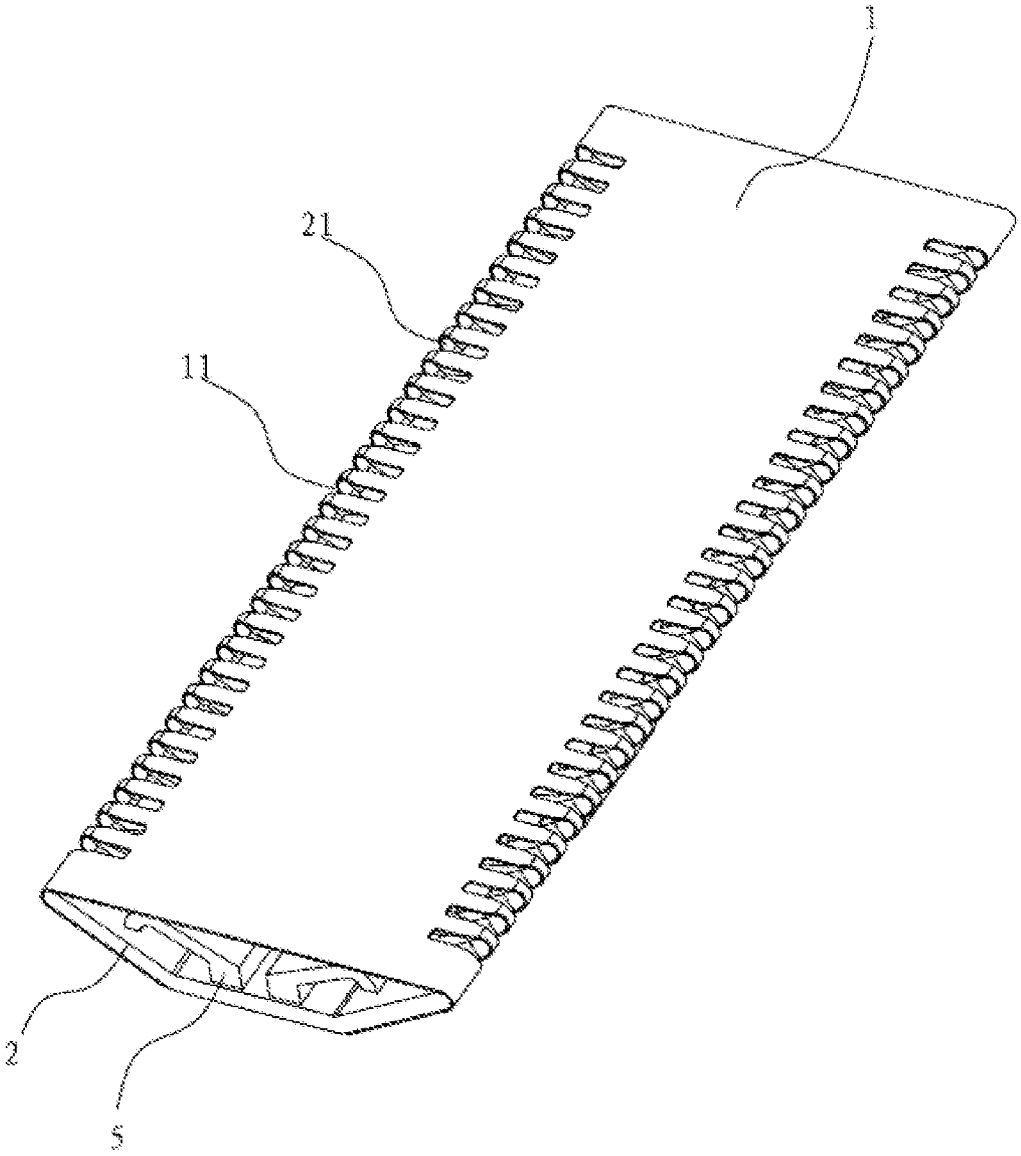
FIG. 1 is a structural schematic diagram of a reciprocating electric razor head of the present invention.
Figure 2:
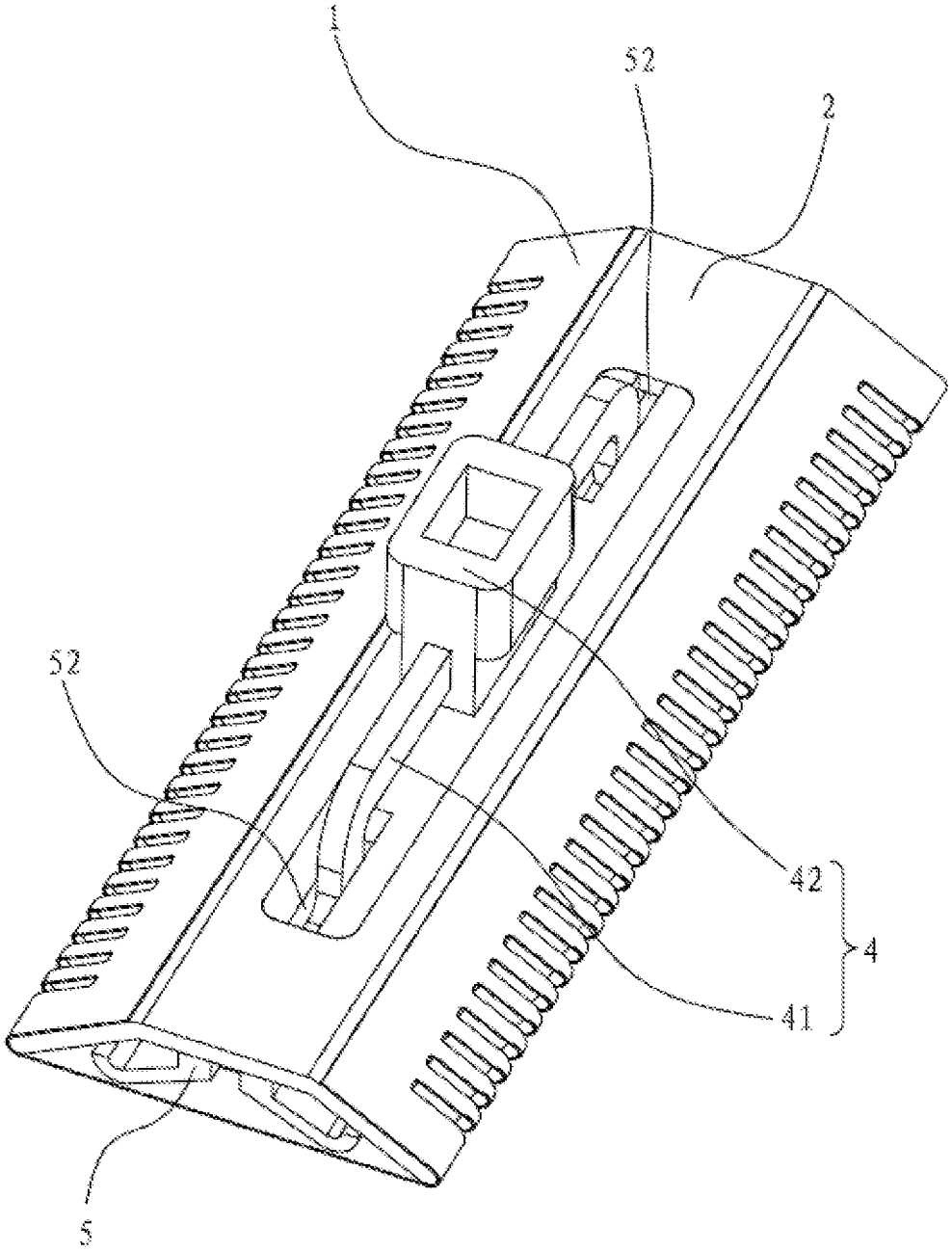
FIG. 2 is a structural schematic diagram of the reciprocating electric razor head of the present invention.
Figure 3:
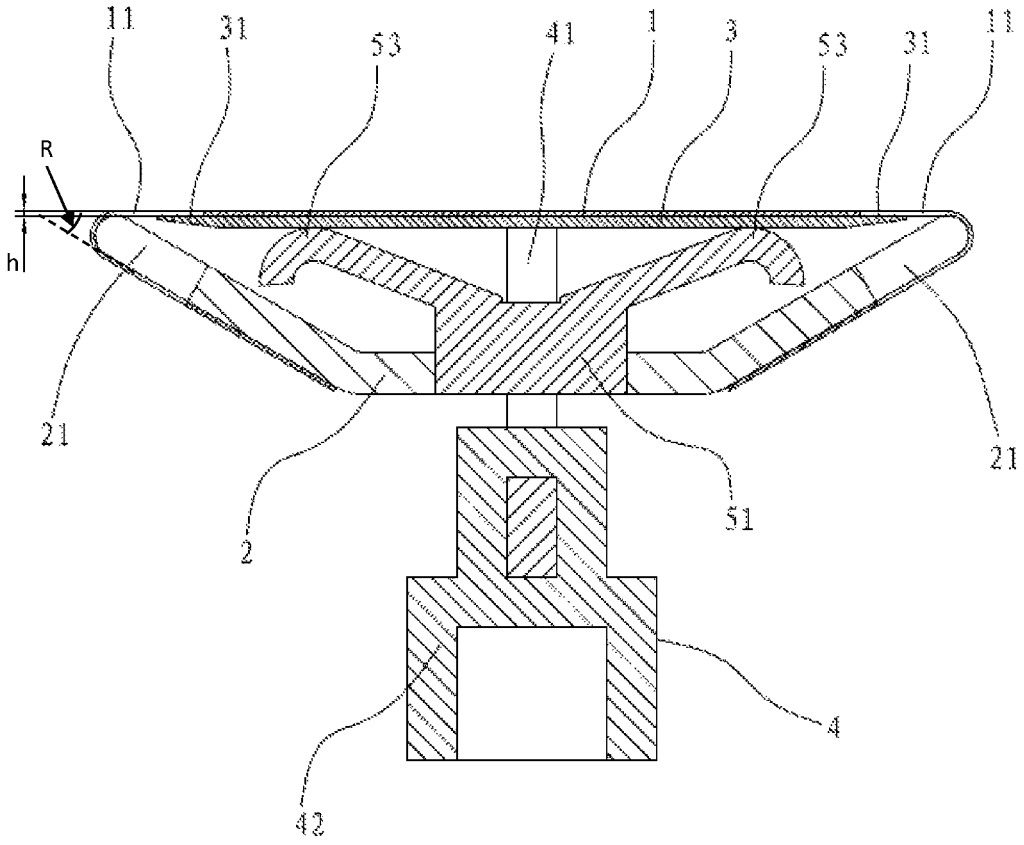
FIG. 3 is a cross-sectional diagram of the reciprocating electric razor head of the present invention.
Figure 4:
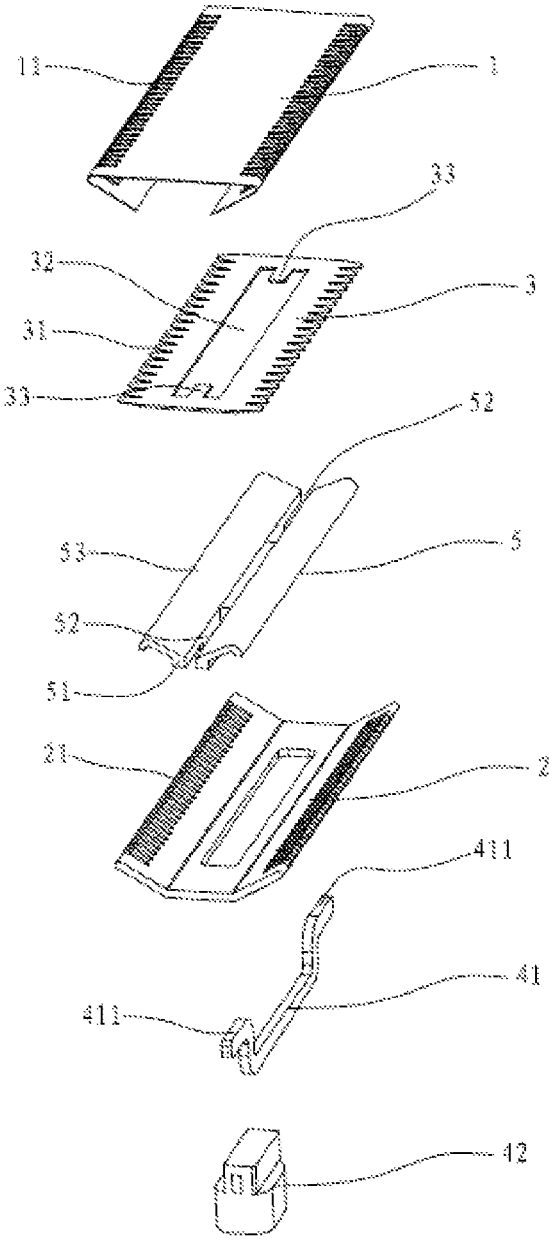
FIG. 4 is an exploded diagram of the reciprocating electric razor head of the present invention.

The present invention will be further illustrated below in conjunction with the accompanying drawings:

Embodiment 1

A reciprocating electric razor head as shown in FIGS. 1-4 is provided, including a fixed blade 1 and a fixed blade support 2 for supporting and fixing the fixed blade 1, wherein the fixed blade 1 is a flexible metal sheet having suppleness; the fixed blade support 2 is a rigid support, and the cross-section of the fixed blade support 2 is arcuate; the fixed blade 1 is supported by the edges on both left and right sides of the fixed blade support 2; under the action of a certain external force, both left and right ends of the fixed blade 1 are bent and tensioned downwardly along an arcuate outer side of the fixed blade support 2 to lie flat against the fixed blade support 2, and the fixed blade 1 is tightly fixed to a lateral face or a bottom face of the fixed blade support 2 by means of welding, riveting or gluing; the fixed blade 1 is provided with hair entrance holes 11 for body hair to enter, and an inner side of the fixed blade 1 is provided with a movable blade 3 capable of moving backward and forward in a reciprocating manner relative to the fixed blade to cut off the body hair inside the hair entrance holes 11; the reciprocating electric razor head further includes a transmission component 4 for connecting the movable blade 3 with a power device of an electric shaver.

The fixed blade 1 is a flexible metal sheet, which is featured by suppleness and toughness, and the fixed blade support 2 is of an arcuate structure having rigidness. Moreover, the fixed blade 1 is tensioned and then fixed to both sides of the fixed blade support 2 to form a structure similar to a bow-bowstring one, wherein the bowstring is stretched by means of the bow, such that the bowstring (namely the fixed blade 1) has a stretching force. With this bow-bowstring structure, the fixed blade 1 can be tightened, via the stretching force, to the fixed blade support 2 to form a stable shaving face thereon. As the shaving face is not required to be maintained through the rigidness of the material, the rigidness requirements for the fixed blade 1 are extremely low, or the fixed blade is not required to be rigid. Consequently, the thickness of the fixed blade 1 can be made to be ultra-thin, which can't be implemented in other process structures. As such, the influence exerted by the thickness of the fixed blade 1 is negligible during shaving, and body hair can be removed cleanly in one time. It is particularly preferred that the thickness h of the fixed blade 1 satisfies $0<h\leq 0.08$ mm. In this manner, body hair can be removed more completely and cleanly.

Furthermore, as it is a flexible metal sheet, and is propped open by the fixed blade support 2 in an outward manner and tightened thereto, the fixed blade 1 can obtain a very flat cutting working face contacting the movable blade 3 without the need for additional precision machining. Moreover, the processes for making and processing the fixed blade are simple, and machining is convenient. As such, costs are saved.

Figure 5:
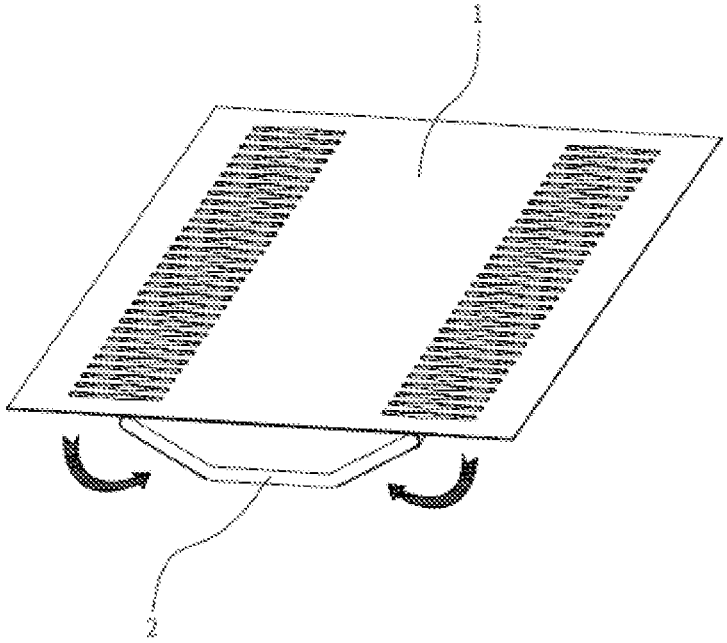
FIG. 5 is a schematic diagram of a process for assembling a fixed blade and a fixed blade support of the present invention.

In addition, as shown in FIG. 5, with regard to the process for fixing the fixed blade 1 with the fixed blade support 2, both left and right ends of the fixed blade 1 are supported by the edges on both left and right sides of the fixed blade support 2, and are bent and tensioned downwardly along the arcuate outer side of the fixed blade support 2 to lie flat against the fixed blade support 2 and below the cutting plane of the fixed blade 1, namely on the lateral face or bottom face of the fixed blade support 2, and the fixed blade 1 is fixed by means of welding, riveting or gluing. This process is simple and convenient to operate, and the smoothness of the cutting working face can be prevented from being affected in the process for fixing the fixed blade 1 with the fixed blade support 2. Moreover, as both left and right ends of the fixed blade 1 are supported by the edges on both left and right sides of the fixed blade support 2 and bent downwardly, an R angle is formed, such that the surface where the fixed blade contacts the skin is smooth, thus offering comfortable shaving experience and high safety.

The hair entrance holes 11 are equally arranged on both left and right sides of the fixed blade 1, which facilitates the entry and removal of body hair; moreover, shaving can be achieved when the left and right sides are pushed; alternatively, the hair entrance holes 11 may be equally arranged only on the left side or the right side of the fixed blade 1.

Hair entrance slots 21 for body hair to enter are provided at positions on the fixed blade support 2 corresponding to the hair entrance holes 11. These hair entrance slots 21 eliminate the influence exerted by the fixed blade support 2 on the entry of body hair, thus facilitating the entry of body hair; the movable blade 3 is provided with cutting teeth 31 corresponding to the hair entrance holes 11 and used for cutting body hair.

The transmission component 4 includes a movable blade support 41 fixedly connected to the movable blade 3 and a driving mount 42 connected with the power device of the electric shaver, wherein the driving mount 42 is fixedly connected with the movable blade support 41, thereby achieving synchronous motion of the movable blade 3, the driving mount 42 and the movable blade support 41.

In order to ensure that during the reciprocating motion of the movable blade 3, there is no relative deviation between the movable blade 3 and the fixed blade 1 in the vertical direction, and gaps are prevented from forming between these two shades, a movable blade pressing member 5 capable of pressing the movable blade 3 on the fixed blade 1 is provided between the movable blade 3 and the fixed blade support 2. In this manner, body hair can be removed more easily, which confirms the sharpness of the reciprocating electric razor head.

The movable blade pressing member 5 includes a body 51, a middle portion of the body 51 is provided with a strip-shaped hole 52 for the movable blade support 41 to pass therethrough and slide therein, and the strip-shaped hole 52 cooperates with the movable blade support 41 to constitute a guiding mechanism for guiding the movable blade 3 to move backward and forward in a reciprocating manner; both sides of the body 51 are provided respectively with elastic pressing plates 53 capable of pressing the movable blade 3 on the fixed blade 1. These elastic pressing plates 53 push the movable blade 3 upward, such that the movable blade 3 and the fixed blade 1 are tightly appressed to each other to form a pre-pressing force. In this manner, gaps are prevented from forming between the movable blade 3 and the fixed blade 1, which avoids the problem of unclean removal, and meanwhile, the sharpness performance of the reciprocating electric razor head for removing body hair is ensured.

A through-hole 32 is provided in the middle of the movable blade 3, wherein front and rear ends of the through-hole 32 are each provided with a movable blade connecting portion 33 protruding in the through-hole 32, such that the movable blade connecting portions 33 project beyond the body of the movable blade 3. The movable blade support 41 is provided with movable blade support connecting portions 411 for mating with the movable blade connecting portions 33 to connect the movable blade 3 with the movable blade support 41. In this manner, the movable blade connecting portions 33 are prevented from being deformed in the process (e.g., welding or riveting) for fixedly connecting the movable blade connecting portions with the movable blade support connecting portions 411. Consequently, the flatness of the movable blade 3 is improved, thus ensuring the sharpness of the overall cutting point of the reciprocating electric razor head.

Moreover, with regard to its structure, this reciprocating electric razor head is also featured by a small volume and a compact size.

Embodiment 2

Figure 6:
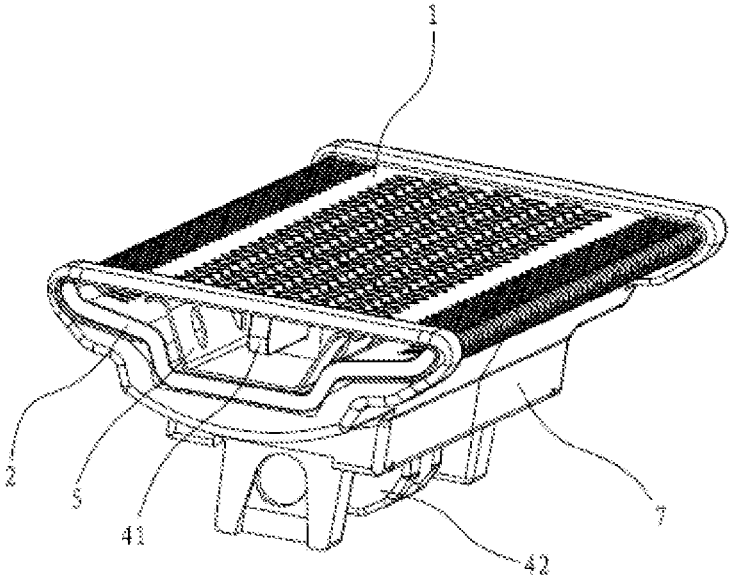
FIG. 6 is a structural schematic diagram of another embodiment of the present invention.
Figure 7:
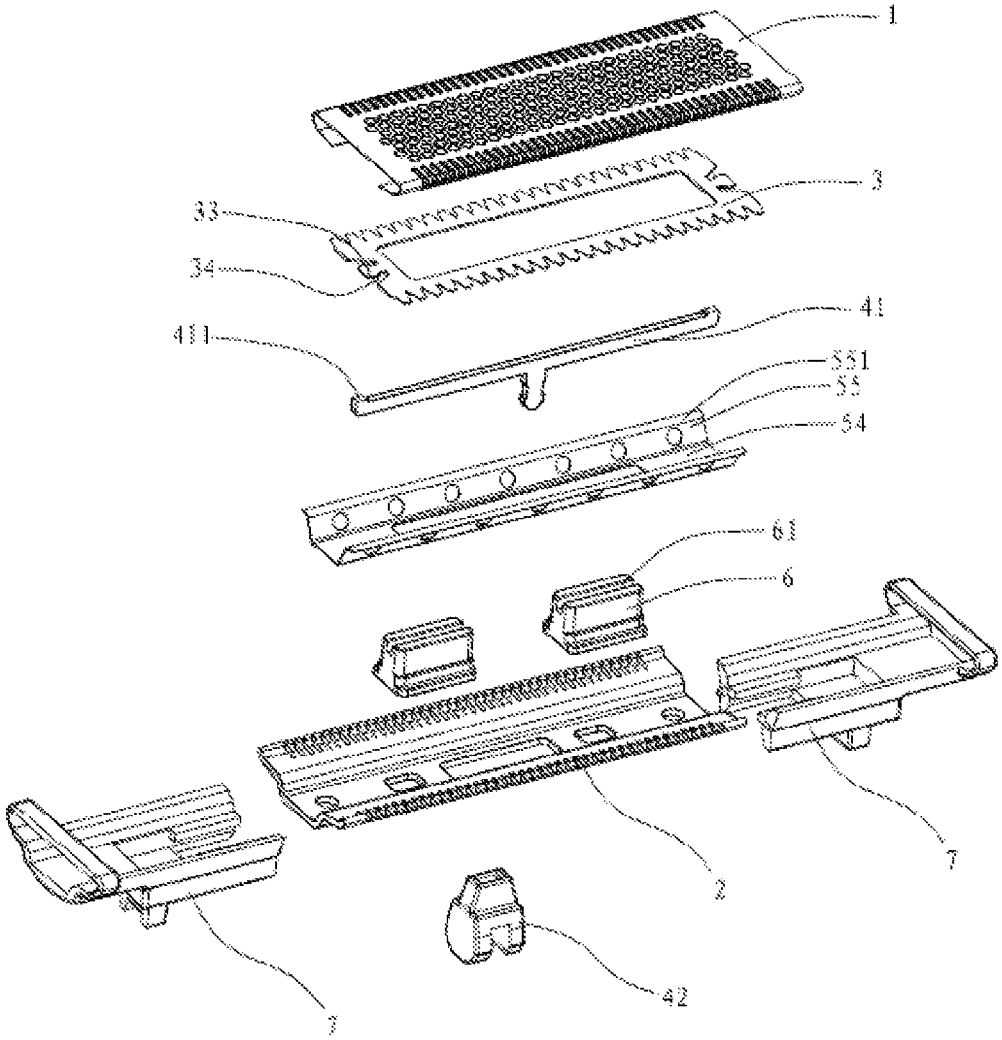
FIG. 7 is an exploded diagram of the embodiment in FIG. 6 of the present invention.
Figure 8:
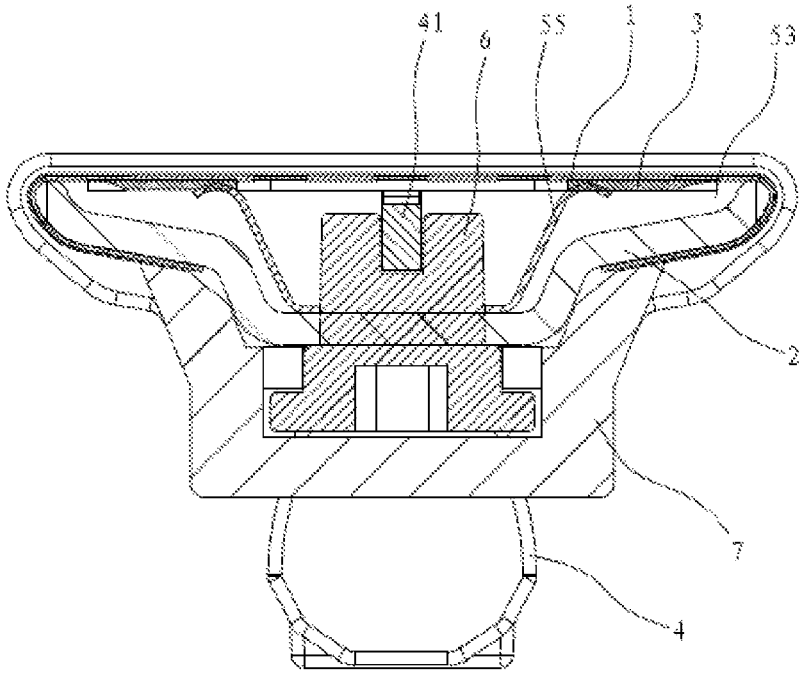
FIG. 8 is a cross-sectional diagram of the embodiment in FIG. 6 of the present invention.

Embodiment 2 as shown in FIGS. 6-8 is distinguished from Embodiment 1 in the following aspects: the movable blade pressing member 5 includes a supporting portion 54 supported on the fixed blade support 2, and includes a pair of elastic arms 55 for pushing the movable blade 3 upward, wherein each elastic arm 55 is provided with a curved portion 551 for pushing the movable blade 3 upward; the fixed blade support 2 is provided with two limit blocks 6, wherein each limit block 6 is provided with a strip-shaped slot 61 for mating with the movable blade support 41 and restricting the movable blade support 41 from moving horizontally; the strip-shaped slot 61 is used for guiding the movable blade 3 to move backward and forward in a reciprocating manner; moreover, the movable blade pressing member 5 is a sheet metal member, which ensures that the elastic arms 55 have good elasticity; as such, while the movable blade 3 is tightly appressed to the fixed blade 1, the movable blade 3 can better perform reciprocating motion under the actions of the fixed blade 1 and the elastic arms 55; moreover, the structure is simple, and manufacturing costs are low.

Furthermore, in the present embodiment, both ends of the movable blade 3 are provided with inner recesses 34, wherein the movable blade connecting portions 33 are arranged to protrude in the inner recesses 34, such that the movable blade connecting portions 33 project beyond the body of the movable blade 3. In this manner, the movable blade connecting portions 33 are prevented from being deformed in the process (e.g., welding or riveting) for fixedly connecting the movable blade connecting portions with the movable blade support connecting portions 411. Consequently, the flatness of the movable blade 3 is improved, thus ensuring the sharpness of the overall cutting point of the reciprocating electric razor head.

In addition, the reciprocating electric razor head further includes a head support 7 mainly used for mounting and connecting to a handle.

What is claimed is:

1. A reciprocating electric razor head, comprising:

a fixed blade (1) and a fixed blade support (2) supporting and fixing the fixed blade (1), wherein the fixed blade (1) is a flexible metal sheet having suppleness;

the fixed blade support (2) is a rigid support, and the fixed blade support (2) comprises a flat portion and two angular portions respectively extending from two ends of the flat portion to form left and right sides of the fixed blade support (2);

the fixed blade (1) is supported by edges on both the left and the right sides of the fixed blade support (2);

the fixed blade (1) having left and right ends, each of the left and right ends are bent downwardly around the respective edges on the left and right sides of the fixed blade support (2) and tensioned downwardly along a respective outer side of each of the left and right sides of the fixed blade support (2) to lie flat against the respective outer side of the fixed blade support (2), and the fixed blade (1) is tightly fixed to the outer sides of the fixed blade support (2) by welding or riveting the left and right ends of the fixed blade (1) to the respective outer side of the fixed blade support (2) to provide the downward tension;

the fixed blade (1) is provided with hair entrance holes (11) for body hair to enter, and an inner side of the fixed blade (1) is provided with a movable blade (3), wherein the movable blade is movable backward and forward in a reciprocating manner relative to the fixed blade to cut off the body hair that extends through the hair entrance holes (11);

the reciprocating electric razor head further comprises a transmission component (4) for connecting the movable blade (3) with a power device of an electric shaver;

wherein the transmission component (4) comprises a movable blade support (41) fixedly connected to the movable blade (3) and a driving mount (42) for connecting with the power device of the electric shaver; and wherein an elongated movable blade pressing member (5) that extends along a length of the movable blade (3) and presses the movable blade (3) against the fixed blade (1) is provided between the movable blade (3) and the fixed blade support (2).

2. The reciprocating electric razor head of claim 1, wherein the fixed blade (1) has a thickness of h, which satisfies $0<h\leq 0.08$ mm.

3. The reciprocating electric razor head of claim 1, wherein the hair entrance holes (11) are equally arranged on a left side and/or a right side of the fixed blade (1).

4. The reciprocating electric razor head of claim 3, wherein hair entrance slots (21) for the body hair to enter are provided at positions on the fixed blade support (2) corresponding to the hair entrance holes (11), and the movable blade (3) is provided with cutting teeth (31) corresponding to the hair entrance holes (11) and used for cutting the body hair.

5. The reciprocating electric razor head of claim 1, wherein the movable blade pressing member (5) comprises a body (51), wherein a middle portion of the body (51) is provided with a strip-shaped hole (52) such that the movable blade support (41) passes therethrough and slides therein, and both sides of the body (51) are provided respectively with elastic pressing plates (53) to press the movable blade (3) against the fixed blade (1).

6. The reciprocating electric razor head of claim 1, wherein the movable blade pressing member (5) comprises a supporting portion (54) supported on the fixed blade support (2) and an elastic arm (55) for pushing the movable blade (3) upward, and the elastic arm (55) is provided with a curved portion (551) for pushing the movable blade (3) upward to press the movable blade (3) against the fixed blade (1).

7. The reciprocating electric razor head of claim 6, wherein the fixed blade support (2) is provided with a limit block (6), wherein the limit block (6) is provided with a strip-shaped slot (61) that mates with the movable blade support (41) for restricting the movable blade support (41) from moving horizontally.

8. The reciprocating electric razor head of claim 1, wherein a through-hole (32) is provided in a middle of the movable blade (3), and the movable blade is provided with movable blade connecting portions (33) projecting beyond a body of the movable blade (3), and the movable blade support (41) is provided with movable blade support connecting portions (411) that respectively mate with the movable blade connecting portions (33) to connect the movable blade (3) with the movable blade support (41).

* * * * *